United States Patent [19]

Weiler et al.

[11] Patent Number: 4,519,513

[45] Date of Patent: May 28, 1985

[54] CONTAINER HAVING PIERCEABLE INSERT

[75] Inventors: Gerhard H. Weiler, South Barrington; Louis T. Pagels, Hanover Park, both of Ill.

[73] Assignee: Automatic Liquid Packaging, Inc., Arlington Heights, Ill.

[21] Appl. No.: 412,608

[22] Filed: Aug. 30, 1982

[51] Int. Cl.[3] ..... B65D 41/20

[52] U.S. Cl. ..... 215/32; 215/247; 215/250; 604/415

[58] Field of Search ..... 215/247, 249, 250, 248, 215/DIG. 3, 32; 150/8; 604/415

[56] References Cited

U.S. PATENT DOCUMENTS

| | | | |
|---|---|---|---|
| 2,135,386 | 11/1938 | Crabbe | 215/DIG. 3 |
| 3,343,699 | 9/1967 | Nicko | 215/247 |
| 3,394,831 | 7/1968 | Bathish et al. | 215/249 |
| 3,653,528 | 4/1972 | Wimmer | 215/DIG. 3 |
| 3,875,012 | 4/1975 | Dorn et al. | 215/247 X |
| 4,046,276 | 9/1977 | Winchell et al. | 215/250 |
| 4,152,378 | 5/1979 | Vcelka et al. | 215/250 X |
| 4,219,912 | 9/1980 | Adams | 215/247 X |
| 4,226,334 | 10/1980 | Weiler et al. | 215/247 X |

FOREIGN PATENT DOCUMENTS

| | | | |
|---|---|---|---|
| 462602 | 1/1950 | Canada | 604/415 |
| 263437 | 5/1964 | Netherlands | 215/247 |

*Primary Examiner*—Donald F. Norton

*Attorney, Agent, or Firm*—Dressler, Goldsmith, Shore, Sutker & Milnamow, Ltd.

[57] ABSTRACT

A thermoplastic container is shown having an insert sealing the container. The insert includes a membrane which can be pierced to provide access to the inside of the container to draw off a substance such as a sterile liquid. The insert is held by a retaining structure which receives and seals with the insert.

22 Claims, 4 Drawing Figures

CONTAINER HAVING PIERCEABLE INSERT

TECHNICAL FIELD OF THE INVENTION

The present invention relates to thermplastic containers, and in particular to thermoplastic containers having inserts permitting access to the contents of the container.

BACKGROUND OF THE INVENTION

Packaging systems that form, fill and seal containers such as thermoplastic bottles and bags enjoy widespread commercial acceptance through ease of operation and reduced labor costs. A container of this type is formed of thermoplastic material, filled with the desired substance, and then sealed in one continuous operation. Generally, these containers are hermetically sealed after the container contents are introduced into the lower portion by pressing together the upper portion of the plastic container which is still soft and sealable. Such a packaging system obviates the need for costly auxiliary equipment to clean and handle empty containers, fill the containers, and seal the containers. The system is particularly desirable where a sterilized fluid is to be sealed within the container and thereafter maintained in a sterile condition.

However, some means must be provided to open the container and obtain access to the material within the container. In medical applications it is desirable to use a cannula or a spike to draw off liquid, e.g., sterile saline, in the container. Such use requires a piercable membrane on the container and preferably also means to seal with the cannula or spike. Thermoplastic molding including the form, fill and seal method can be used to make such a membrane as a unitary part of the container. However the system tolerances required increase the cost of the container or package ultimately produced. Some of the problems encountered are control of the thickness of the membrane, and provision of a convenient location on the container for molding the membrane and the subsequent piercing of the molded membrane. While the membrane can be conveniently pierced when located along the longitudinal axis of the container, such a location usually entails placing a parting line across the surface of the membrane. Such a parting line can interfere with piercing and sealing of the cannula with the membrane unless special precautions are taken.

It would be desirble to produce a container which avoids the shortcomings of the prior art containers and presents a pierceable membrane in a convenient, predetermined location. It would also be desirable if that membrane could be pierced by a cannula which would then seal with the container while in place. It would be further desirable if such a container can be produced by efficient production methods. The present invention meets these desires.

SUMMARY OF THE INVENTION

The present invention contemplates a thermoplastic container which can be manufactured by the form, fill and seal technique. The container generally includes a body portion defining an opening at one end and a retaining structure unitary with the body portion about the opening. An insert is provided having an insert member defining a passageway and a membrane sealing the passageway. The insert is sealingly retained by the retaining structure such that the membrane can be pierced to provide access to the interior of the enclosure.

To facilitate sealing with the retaining structure the insert can be provided with an annular flange about the periphery of the body. Preferably, the annular flange is tapered radially outwardly. A portion of the retaining structure partially surrounds the flange to seal with and retain the insert. Preferably, the passageway within the insert is a bore which is adapted to sealingly engage with piercing means such as a cannula. Thus, it is possible to pierce the membrane and insert a cannula to draw off the container contents without leakage.

Because the insert is molded separately from the remainder of the container, a wide variety of insert configuration is possible. Quality control also is simplified. The insert can be substantially rigid and can be molded of the same material as the rest of the container. The insert membrane can be molded to any desired thickness without a parting line and the bore can be molded to have a smooth, generally cylindrical surface or even provided with internal threads, if desired.

This is particularly desirable where the liquid to be stored in the container is a sterile solution used for medical purposes, such as the various intravenously administered solutions, or the like. The form, fill and seal production technique insures the sterility of the solution while the insert with its pierceable membrane provides easy and safe access to the solution. The use of a cannula to pierce the membrane and seal with the container allows the solution to be drawn off and still maintain its sterility.

Numerous other advantages and features of the present invention will become more readily apparent from the following detailed description of the preferred embodiments of the invention, the drawings, and the appended claims.

DESCRIPTION OF THE PREFERRED EMBODIMENTS

Figure 1:
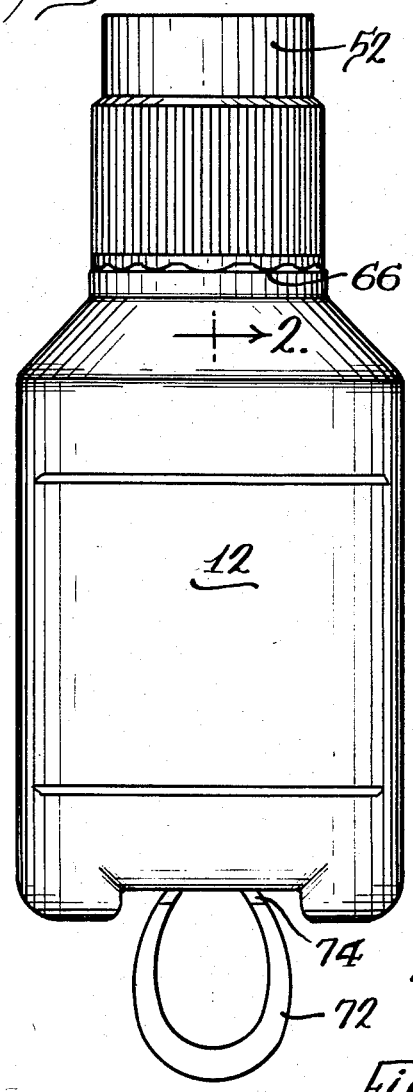
FIG. 1 is a side elevational view showing a container embodying the present invention.

While this invention is susceptible of embodiment in many different forms, there are shown in the drawings and will be described in detail, preferred embodiments of the invention. It should be understood, however, that the present disclosure is to be considered as an exemplification of the principles of the invention and is not intended to limit the invention to the embodiments illustrated.

For ease of description, the container embodying this invention will be described in an upright position and such terms as upper and lower will be used in reference to this position. It will be understood, however, that the container embodying this invention may be used in an orientation other than a position described.

Figure 2:
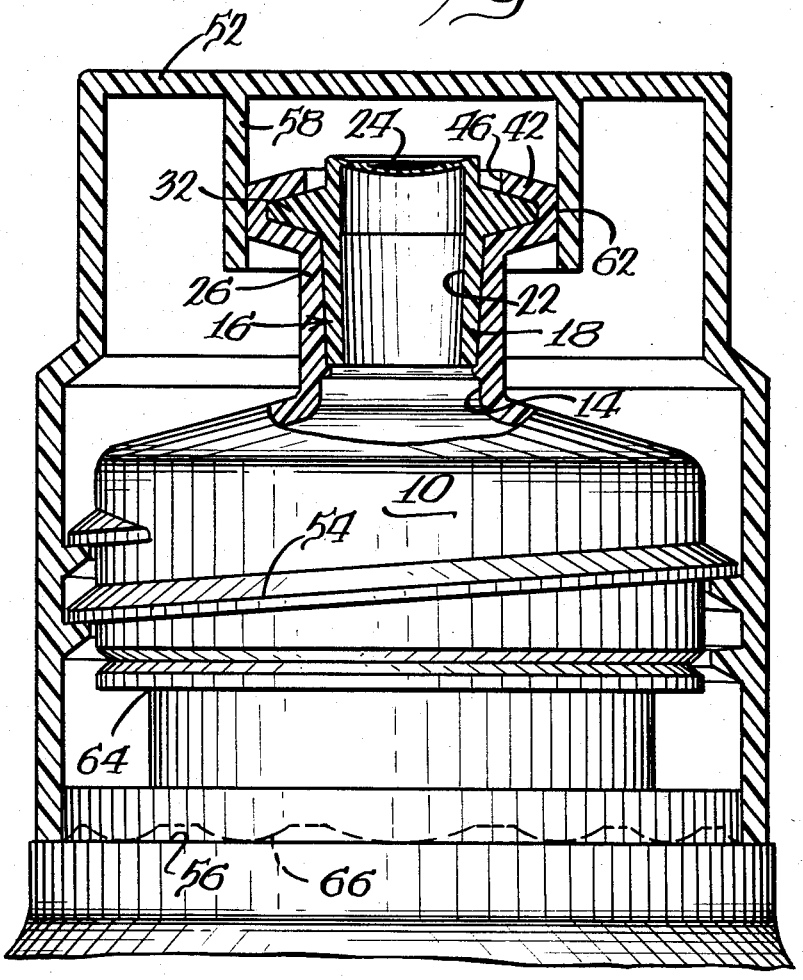
FIG. 2 is a fragmentary enlarged side elevational view taken along plane 2—2 of FIG. 1, partly in section, showing the details of an insert of the container.
Figure 3:
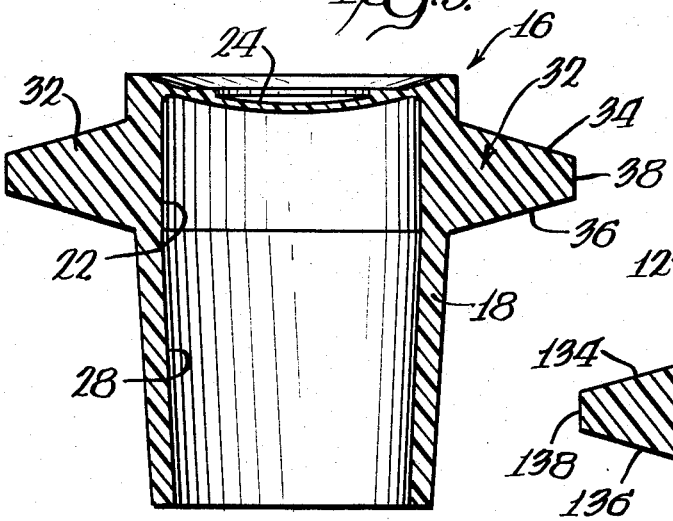
FIG. 3 is an enlarged cross-sectional view of the insert of FIG. 2.

A container embodying the present invention can be seen in FIGS. 1–3. The container generally comprises an enclosure or body portion 12 including a neck portion 10 defining an opening 14 at one end. An insert 16 is provided having an elongated member 18 defining a passageway such as bore 22. The passageway is sealed by a membrane 24 on the insert 16. The membrane can be unitary or integral with the insert member 18.

A retaining structure 26 is unitary with the body portion 12 about the opening 14 to hold the insert 16 on the body portion. The insert is received by and seals with the retaining structure 26 such that the membrane can be pierced or broken to provide access to the interior of the body portion 12. The membrane 24 is preferably concave e.g. hemispherical, to guide a piercing means such as a cannula (not shown) towards the center of the bore 22. Alternatively, the insert bore can be utilized to serve as a guide means as will be explained later. The membrane should be exposed beyond the retaining structure, that is, there should be easy access to the membrane from outside the container. An overcap, as discussed below, may also be provided over the membrane.

Preferably, the insert member 18 is cylindrical and the passageway along its length is a generally cylindrical central axial bore 22 which can include an inwardly tapered portion 28. The bore 22 and tapered portion 28 are adapted to frictionally and sealingly engage a cannula which pierces the membrane 24 and enters the bore 22. As shown, the bore 22 is in fluid communication with the interior of the enclosure and is maintained clean or sterile by the membrane 24. The insert 16 preferably does not extend into the interior of the enclosure beyond the retaining structure 26. This allows all of the container contents to flow into the bore 22 when the container is inverted.

The insert is also preferably provided with an annular flange 32 about the periphery of the insert member 18 proximal to and spaced from one end of the member. The circumferential flange has an upper surface 34 and a lower surface 36 which are preferably interconnected by a substantially cylindrical lateral surface or face 38. The upper and lower surfaces are preferably frustoconical and are at an angle of about 105 degrees with respect to the lateral surface insert member 18. The insert flange 32 is subjected to axial and radial compression as the retaining structure 26 is molded about to the insert. This helps to insure a seal between the retaining structure and the insert.

The insert 16 is manufactured separately from the remainder of the container. This allows better control over the membrane thickness as well as molding of smooth or threaded surfaces within the bore 22, with or without a taper as desired. This is not easily possible when membrane 24 and internal bore 22 are molded unitary with the rest of the container. The inside surfaces of such a unitary molded bore cannot be readily controled to provide the desired mating relationship with a cannula. This is possible, however, with the separately molded insert 16 of the present invention.

The membrane 24 has a preferred thickness of about 0.010 inches, but can be as thin as 0.001 inch. The membrane can have a radially variable thickness, e.g., thinnest at the center, to facilitate penetration by a spike, needle, or a cannula. Preferably, the membrane is sufficiently thin to permit penetration by a cannula without coring and also so that a seal can be effected between a cannula and also the bore 22 without membrane debris being pushed inside the container. Such a seal with the membrane 24 can be instead of or together with a seal with the bore 22.

The insert 16, enclosure 12, and retaining structure 26 can be manufactured of any suitable plastic material such as high and low density polyethylene, polypropylene, and the like. The enclosure 12 and the retaining means 26 should be of usual blow-molding grade material and the insert material should be of usual injection molding grade. The insert need not be of the same material as the rest of the container, but it is preferred that it be the same, especially for pharmaceutical applications. This eliminates the possibility of reaction between the insert material and the material from which the rest of the container is made. Inasmuch as the insert is fabricated separately, it can be made more rigid than the container itself by appropriate choice of insert geometry.

As stated above, the insert 16 is held on the body portion 12 by the retaining structure 26. As can be see in FIG. 2, the retaining structure 26 preferably extends at least partially around the radially outwardly tapered flange 32, that is around the lower face 38 and surface 36, on to the upper surface 34 (FIG. 3). A lip 42 of the retaining structure 26 partially surrounds the flange and extends over at least the peripheral portion of the upper surface 34 of the flange 32. This, together with the general frustoconical shape of the upper and lower structure insures a complete seal between the retaining structure 26 and the insert 16. The lateral face 38 also contributes to insure a complete seal with the rigid insert 16.

The lip 42 preferably defines an aperture 46 which is spaced from the insert member 18. Thus, any inward tension of the retaining structure 26 is directed about the flange further enhancing sealing, and is not lost or reduced by pressing against the top part of the insert 16. This coaction of the retaining structure 26 and insert 16 insures a liquid-tight seal even when the insert itself is not very resilient. The retaining structure 26 can also include a removable overcap (not shown) which extends over the aperture 46 and membrane 24 as is common in the pharmaceutical arts for protection of a pierceable membrane.

The container can further be supplied with a rigid cap 52 situated over the retaining structure 26 by appropriate engaging means such as buttress threads 54 on container neck portion 10. The cap 52 can also engage an abutment shoulder 56 on the container body portion 12. Preferably, the cap 52 is provided with an inner collar 58 which cooperates with the cylindrical outer surface 62 of the retaining structure 26 to align and center the cap when it is received on the body portion 12. This also maintains the outer surface of the membrane 24 in a clean condition and minimizes the likelihood of contamination.

The body portion 12 can also be provided with a frangible web portion 64 allowing the top part of the enclosure including the threads 54 to be removed. This provides a larger opening into the enclosure. By forcefully threading the cap 52 down over the threads 54 on the neck portion 10 of body portion 12, the frangible portion 64 can be ruptured, thereby removing the top portion of the enclosure (body portion) 12. The construction of such frangible web portions is discussed in U.S. Pat. No. 3,597,793 to Weiler et al. The bottom of the cap 52 can be provided with a wavy surface or projections 66 so that there is a reduced amount of frictional contact with the abutment shoulder 56 which would otherwise interfere with forceably tightening the cap.

This design therefore can provide two separate systems for gaining access to the container contents. The first is the controlled withdrawal of liquid as by a cannula which penetrates the membranes 24, and the second is by tearing off the top of the enclosure with the provided cap. The cap 52 serves two purposes. It maintains the cleanliness and integrity of the membrane 24 and provides a means for removing the top portion of the enclosure 12.

The container can also be equipped with a flexible hanger means such as loop 72 which can be provided with a unitary hinge 74 and folded flat against the bottom of the enclosure 12 to facilitate storage.

In use, the membrane 24 is generally pierced when the container is upright as shown in FIG. 1 and the cannula seals with the membrane, bore 22, or both. The container is then inverted and hung by the loop 72 as the liquid in the container is drawn off through the cannula. This process is particularly useful with medical solutions such as intravenous liquids and the like. Sterility of the solution is maintained during packaging, storage, and removal from the container.

The general manufacturing techniques of the present form, fill and seal containers, are described in copending U.S. patent application Ser. No. 296,368, A Container with an Encapsulated Top Insert and Method and Apparatus for Making Same, filed on Aug. 26, 1981, and assigned to Automatic Liquid Packaging, Inc. That description is incorporated herein by reference to the extent pertinent.

Figure 4:
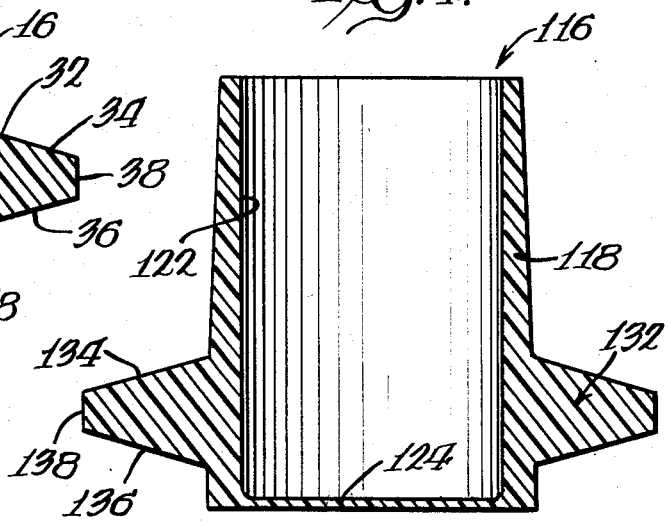
FIG. 4 is a cross-sectional view of an alternative embodiment for insert.

An alternative embodiment for the insert is shown in FIG. 4. In this particular embodiment, the insert 116 has the flange 132 spaced from the bottom end of the insert member 118. The bore 122 is right cylindrical and provides a straight surface to guide, engage and seal with the cannula or other piercing means. This insert 116 is held by the retaining means with the bore 122 exposed outside the container. The bore 122 then serves as a guide for the cannula, centering and directing it to the membrane 124. The upper 134, lower 136, and lateral 138 surfaces are as described above.

Still other variations within the spirit and scope of this invention are possible and will readily present themselves to those skilled in the art.

What is claimed is:

1. A form, fill and seal container of a thermoplastic material, comprising:

(a) a body portion defining an opening at one end;

(b) an insert having a member defining a passageway and having a membrane sealing the passageway, said membrane having a thickness of about 0.010 inches or less; and (c) a retaining structure unitary with the body portion about the defined opening, the insert being received by and sealing with the retaining structure such that the membrane can be pierced to provide access to the interior of the body portion;

said insert including an annular flange about the periphery of the insert member, spaced from the end of the insert, and having an upper surface and a lower surface, at least one of said surfaces being of a frustoconical configuration; and said retaining structure extending about the flange with a lip on the retaining structure extending over at least the peripheral portion of the upper surface of said flange from the outer periphery of said flange but spaced from the inner edge of said flange.

2. The container of claim 1 wherein the body portion includes a neck portion defining the opening.

3. The container of claim 1 wherein the flange is proximal to one end of the insert member.

4. The container of claim 1 wherein the frustoconical surface is at an angle of about 105 degrees with respect to the side of the insert member.

5. The container of claim 1 wherein the insert member is generally cylindrical.

6. The container of claim 1 including a liquid received inside the body portion.

7. The container of claim 1 wherein the insert is more rigid than the surrounding retaining structure.

8. The container of claim 1 wherein the insert, retaining structure and body portion are of the same material.

9. A form, fill and seal container of a thermoplastic material, comprising:

(a) a body portion defining an opening at one end;

(b) an insert having a member defining a passageway and having a membrane sealing the passageway; and (c) a retaining structure unitary with the body portion about the defined opening, the insert being received by and sealing with the retaining structure such that the membrane can be pierced to provide access to the interior of the body portion, said membrane being exposed beyond the retainng structure and having a generally concave shape with a thickness of about 0.010 inches or less.

10. A hermetically sealed dispensing container comprising:

(a) a body portion including a neck portion, the neck portion defining an opening;

(b) an insert having a generally hollow cylindrical member defining a generally cylindrical bore along its length with a membrane sealing the bore, said membrane having a thickness substantially less than the annular thickness of said member measured radially from the bore to the exteior of said member, the insert also having an annular flange on the exterior of the member spaced from the ends of the insert, the flange having an upper surface and a lower surface; and (c) a retaining structure unitary with the neck portion about the opening, the retaining structure receiving and sealing with the insert with a portion of the retaining structure partially surrounding the flange and having a lip extending over at least a portion of said upper surface of said flange from the outer periphery of said flange but spaced from the inner edge of said flange, such that the membrane can be pierced to provide access to the interior of the body portion; and at least one of said upper surface and said lower surface having a frustoconical configuration.

11. The container of claim 10 wherein the flange also has a lateral surface between the upper and lower surfaces, the lateral surface being substantially cylindrical.

12. The container of claim 11 wherein the bore is right cylindrical.

13. The container of claim 10 wherein the bore includes an inwardly tapered portion in fluid communication with the interior of the enclosure.

14. The container of claim 10 wherein the upper surface and lower surface are frustoconical.

15. The container of claim 14 wherein the upper and lower frustoconical surfaces but spaced from the insert are at an angle of about 105 degrees with respect to the side of the insert member.

16. The container of claim 10 including a sterile solution received inside the enclosure.

17. The container of claim 10 wherein the insert is more rigid than the container.

18. The container of claim 10 wherein the insert, retaining structure, and body portion are of the same material.

19. A hermetically sealed dispensing container comprising:

(a) a body portion including a neck potion, the neck portion defining an opening;

(b) an insert having a generally cylindrical member defining a generally cylindrical bore along its length with a membrane sealing the bore, said membrane having a thickness substantially less than the annular thickness of said member measured radially from the bore to the exterior of said member, the insert also having an annular flange on the exterior of the member, the flange having an upper surface and a lower surface; and (c) a retaining structure unitary with the neck portion about the opening, the retaining structure receiving and sealing with the insert with a portion of the retaining structure partially surrounding the flange and extending over at least a portion of the top surface, such that he membrane can be pierced to provide access to the interior of the body portion, said membrane having a generally concave shape and being exposed beyond the retaining structure.

20. A hermetically sealed dispensing container comprising:

(a) a body portion including a neck portion, the neck portion defining an opening;

(b) an insert having a generally hollow cylindrical member defining a single, generally cylindrical bore along its length oriented coaxially with said insert, the insert having a membrane sealing the bore, said membrane having a thickness substantially less than the annular thickness of said member measured radially from the bore to the exterior of said member, the insert also having an annular flange on the exterior of the member, the flange having an upper surface and a lower surface; and (c) a retaining structure unitary with the neck portion about the opening, the retaining structure receiving and sealing with the insert with a portion of the retaining structure partially surrounding the flange and extending over at least a portion of the top surface, such that the membrane can be pierced to provide access to the interior of the body portion; and (d) a threaded cap and threads on the container neck portion for holding the cap over the retaining structure.

21. A hermetically sealed dispensing container comprising:

(a) a body portion including a neck portion, the neck portion defining an opening;

(b) an insert having a generally cylindrical member defining a generally cylindrical bore along its length with a membrane sealing the bore, the insert also having an annular flange on the exterior of the member, the flange having an upper surface and a lower surface; and (c) a retaining structure unitary with the neck portion about the opening, the retaining structure receiving and sealing with the insert with a portion of the retaining structure partially surrounding the flange and extending over at least a portion of the top surface, such that the membrane can be pierced to provide access to the interior of the body portion; and (d) a threaded cap and threads on the container neck portion for holding the cap over the retaining structure; and (e) an abutment shoulder and a circumferential frangible web portion between the abutment shoulder and the threads, the abutment shoulder cooperating with the cap to break the frangible web portion as the cap is threaded onto the neck portion while abutting the shoulder.

22. A hermetically sealed dispensing container comprising:

(a) a body portion including a neck portion, the neck portion defining an opening;

(b) an insert having a generally cylindrical member defining a generally cylindrical bore along its length with a membrane sealing the bore, the insert also having an annular flange on the exterior of the member, the flange having an upper surface and a lower surface; and (c) a retaining structure unitary with the neck portion about the opening, the retaining structure receiving and sealing with the insert with a portion of the retaining structure partially surrounding the flange and extending over at least a portion of the top surface, such that the membrane can be pierced to provide access to the interior of the body portion; and (d) a threaded cap and threads on the container neck portion for holding the cap over the retaining structure, said retaining structure defining a generally cylindrical outer surface and the cap including a collar which cooperates with the outer surface to receive the retaining structure and center the cap.

* * * * *

UNITED STATES PATENT AND TRADEMARK OFFICE

CERTIFICATE OF CORRECTION

PATENT NO. : 4,519,513

DATED : May 28, 1985

INVENTOR(S) : Gerhard H. Weiler and Louis T. Pagels

It is certified that error appears in the above-identified patent and that said Letters Patent is hereby corrected as shown below:

Col. 4, line 26, "structure" should be -- surfaces --.

Col. 6, line 68, delete "but spaced from the insert".

Signed and Sealed this

*Nineteenth* Day of *November 1985*

[SEAL]

*Attest:*

DONALD J. QUIGG

*Attesting Officer*

*Commissioner of Patents and Trademarks*